US012723351B2

(12) United States Patent
Aruga

(10) Patent No.: US 12,723,351 B2
(45) Date of Patent: Sep. 1, 2026

(54) SHEET MANUFACTURING APPARATUS

(71) Applicant: SEIKO EPSON CORPORATION, Tokyo (JP)

(72) Inventor: Naoto Aruga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 495 days.

(21) Appl. No.: 18/366,722

(22) Filed: Aug. 8, 2023

(65) Prior Publication Data

US 2024/0052568 A1 Feb. 15, 2024

(30) Foreign Application Priority Data

Aug. 10, 2022 (JP) ..... 2022-127730

(51) Int. Cl.
*D21F 1/52* (2006.01)
*D21F 1/34* (2006.01)

(52) U.S. Cl.
CPC . *D21F 1/52* (2013.01); *D21F 1/34* (2013.01)

(58) Field of Classification Search
CPC ... D21F 11/00; D21F 9/00; D21F 1/52; D21F 1/34
See application file for complete search history.

(56) References Cited

U.S. PATENT DOCUMENTS

2010/0107673 A1* 5/2010 Nakaguro ..... F24F 3/1411 62/271
2021/0206019 A1 7/2021 Miyazawa et al.

FOREIGN PATENT DOCUMENTS

CN 108699741 A 10/2018
CN 210655382 U 6/2020
JP 2019-044284 A 3/2019

* cited by examiner

*Primary Examiner* — Jacob T Minskey
(74) *Attorney, Agent, or Firm* — Spencer Fane LLP

(57) ABSTRACT

There is provided a sheet manufacturing apparatus that manufactures a sheet from a material containing fibers, including: an accumulation section that forms a web by accumulating the material containing fibers by an air flow; a web transport section including a transport belt that comes into contact with one surface of the web and holds the web; a humidification section provided to face the one surface of the transport belt and applying moisture from the other surface side of the web; and a suction section provided to face the humidification section with the transport belt interposed therebetween, in which the suction section has a plurality of suction ports for suctioning air, the humidification section has a discharge port for discharging humidified air, and among the plurality of suction ports, a first suction port and the discharge port are disposed to face each other.

10 Claims, 7 Drawing Sheets

SHEET MANUFACTURING APPARATUS

The present application is based on, and claims priority from JP Application Serial Number 2022-127730, filed Aug. 10, 2022, the disclosure of which is hereby incorporated by reference herein in its entirety.

BACKGROUND

1. Technical Field

The present disclosure relates to a sheet manufacturing apparatus.

2. Related Art

In the related art, as described in JP-A-2019-44284, a sheet manufacturing apparatus including an accumulation section that forms a web by accumulating a material containing fibers on a mesh belt; a humidification section disposed downstream of the accumulation section in a web transport direction to humidify the web; a transport section disposed downstream of the humidification section in the web transport direction to transport the web downstream while peeling off the web from the mesh belt; and a pressure roller disposed downstream of the transport section in the web transport direction to pressurize the web, is known.

However, in the sheet manufacturing apparatus, the web is transported downstream from one surface side of the web made of the accumulated fibers while being humidified by the humidification section. At this time, the air flow of the humidified air discharged from the humidification section may become unstable, and thereby the amount of moisture of the web in the in-plane direction may become non-uniform depending on the location. As a result, there is a problem that the strength varies in the sheet surface and the quality of the sheet cannot be ensured.

SUMMARY

According to an aspect of the present disclosure, there is provided a sheet manufacturing apparatus that manufactures a sheet from a material containing fibers, including: an accumulation section that forms a web by accumulating the material containing fibers by an air flow; a web transport section including a transport belt that comes into contact with one surface of the web and holds the web; a humidification section provided to face the one surface of the transport belt and applying moisture from the other surface side of the web; and a suction section provided to face the humidification section with the transport belt interposed therebetween, in which the suction section has a plurality of suction ports for suctioning air, the humidification section has a discharge port for discharging humidified air, and among the plurality of suction ports, a first suction port and the discharge port are disposed to face each other.

DESCRIPTION OF EMBODIMENTS

First, a configuration of a sheet manufacturing apparatus 1 will be described. The sheet manufacturing apparatus 1 is an apparatus for forming a sheet S.

Figure 1:
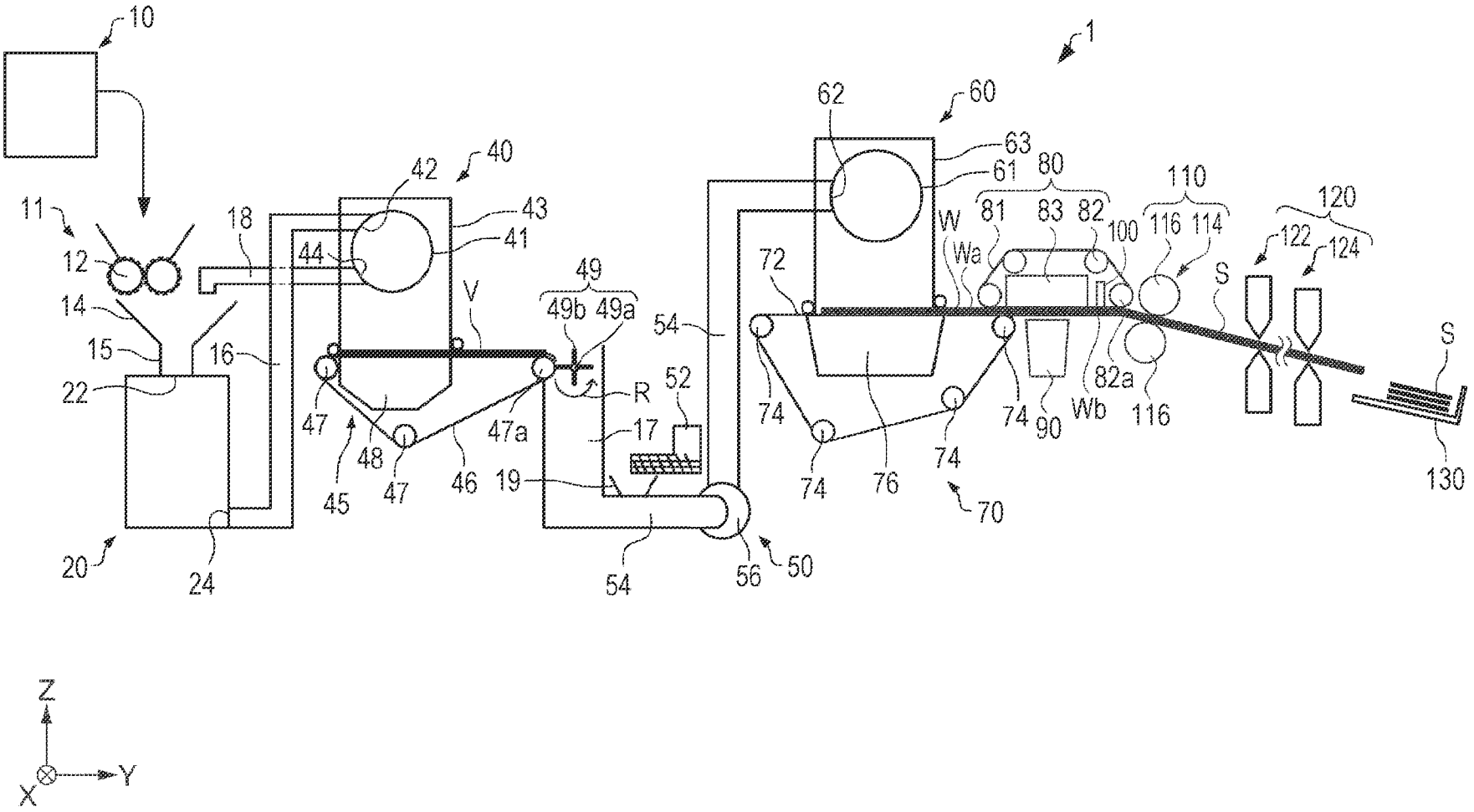
FIG. 1 is a schematic view illustrating a configuration of a sheet manufacturing apparatus.

As illustrated in FIG. 1, the sheet manufacturing apparatus 1 includes, for example, a supply section 10, a crushing section 11, a defibration section 20, a sorting section 40, a first web forming section 45, a rotating body 49, a mixing section 50, an accumulation section 60, a web transport section 80, a humidification section 90, an air ejection section 100, a sheet forming section 110, and a cutting section 120. Furthermore, the sheet manufacturing apparatus 1 includes a control section (processor) that controls a drive mechanism of each of the above sections.

The supply section 10 supplies the raw material to the crushing section 11. The supply section 10 is, for example, an automatic charging section for continuously charging the raw material into the crushing section 11. The raw material supplied by the supply section 10 is a material containing various fibers.

The fiber is not particularly limited, and a wide range of fiber materials can be used. Examples of the fiber include natural fiber (animal fiber, plant fiber) and chemical fiber (organic fiber, inorganic fiber, organic-inorganic composite fiber). More specifically, the fiber includes fibers made of cellulose, silk, wool, cotton, cannabis, kenaf, flax, ramie, jute, Manila hemp, sisal, coniferous tree, broadleaf tree, and the like, and these may be used alone, may be appropriately mixed and used, or may be used as a purified regenerated fiber.

Examples of the raw material of the fiber include pulp, used paper, and used cloth. Further, the fiber may be subjected to various surface treatments. Further, the material of the fiber may be a pure substance or a material containing a plurality of components such as impurities and other components. Further, as the fiber, a defibrated product obtained by defibrating used paper, pulp sheet, or the like by a dry method may be used.

The length of the fiber is not particularly limited, but in a case of one independent fiber, the length of the fiber in the longitudinal direction is 1 μm or more and 5 mm or less, preferably 2 μm or more and 3 mm or less, and more preferably 3 μm or more and 2 mm or less.

In the sheet manufacturing apparatus 1, moisture is applied in the humidification section 90, and thus the mechanical strength of the formed sheet S can be increased by using a fiber having the ability to form hydrogen bonds. Examples of such fibers include cellulose.

The fiber content in the sheet S is, for example, 50% by mass or more and 99.9% by mass or less, preferably 60% by mass or more and 99% by mass or less, and more preferably 70% by mass or more and 99% by mass or less. Such a content can be obtained by performing mixing when forming the mixture.

The crushing section 11 cuts the raw material supplied by the supply section 10 into strips in the air such as the atmosphere. The shape and size of the strips are, for example, several centimeter square. In the illustrated example, the crushing section 11 has a crushing blade 12, and the charged raw material can be cut by the crushing blade 12. As the crushing section 11, for example, a shredder is used. The raw material cut by the crushing section 11 is received by a hopper 14 and then transferred to the defibration section 20 through a pipe 15.

The defibration section 20 defibrates the raw material cut by the crushing section 11. Here, "defibrating" means unraveling a raw material obtained by binding a plurality of fibers into each fiber. The defibration section 20 also has a function of separating substances (such as resin particles, ink, toner, and a blot inhibitor) adhering to the raw material from the fibers.

A product that passed through the defibration section 20 is referred to as "defibrated product". In addition to the unraveled fiber, the "defibrated product" may include resin particles separated from the fiber when the fiber is unraveled, coloring agents such as ink and toner, or additives such as blot inhibitors and paper strength enhancers. The shape of the unraveled defibrated product is a shape of a string. The unraveled defibrated product may exist in a state of not being entangled with other unraveled fibers, that is, in an independent state, or may exist in a state of being entangled with other unraveled defibrated products to form a mass shape, that is, in a state where a lump is formed.

The defibration section 20 performs defibration by a dry method. Here, the treatment of defibrating or the like in the air such as the atmosphere, not in the liquid, is referred to as a dry method. As the defibration section 20, for example, an impeller mill is used. The defibration section 20 has a function of suctioning the raw material and generating an air flow that discharges the defibrated product. Accordingly, the defibration section 20 can suction the raw material together with the air flow from an introduction port 22 by the self-generated air flow, perform the defibration treatment, and transport the defibrated product to a discharge port 24. The defibrated product that passed through the defibration section 20 is transferred to the sorting section 40 through the pipe 16. As the air flow for transporting the defibrated product from the defibration section 20 to the sorting section 40, the air flow generated by the defibration section 20 may be used, or an air flow generation device such as a blower may be provided to use the air flow thereof.

The sorting section 40 introduces the defibrated product defibrated by the defibration section 20 from the introduction port 42 and sorts the defibrated products according to the length of the fibers. The sorting section 40 has, for example, a drum section 41 and a housing section 43 that accommodates the drum section 41 therein. As the drum section 41, for example, a sieve is used. The drum section 41 has a net, and can sort out fibers or particles smaller than the size of the mesh opening of the net, that is, a first sorted product passing through the net, and fibers, undefibrated pieces, and lumps larger than the size of the mesh opening of the net, that is, a second sorted product that does not pass through the net. For example, the first sorted product is transferred to the accumulation section 60 through a pipe 17. The second sorted product is returned from the discharge port 44 to the defibration section 20 through a pipe 18. Specifically, the drum section 41 is a cylindrical sieve that is rotationally driven by a motor. As the net of the drum section 41, for example, a wire net, an expanded metal obtained by stretching a metal plate having a cut, or a punching metal in which a hole is formed in the metal plate by a press machine or the like is used.

The first web forming section 45 transports the first sorted product that passed through the sorting section 40 to the pipe 17. The first web forming section 45 includes, for example, a mesh belt 46, a stretching roller 47, and a suction mechanism 48.

The suction mechanism 48 can suction the first sorted product dispersed in the air through the opening of the sorting section 40 onto the mesh belt 46. The first sorted product is accumulated on the moving mesh belt 46 to form a web V.

The first sorted product that passed through the opening of the sorting section 40 is accumulated on the mesh belt 46. The mesh belt 46 is stretched by the stretching roller 47, and is configured such that the first sorted product is unlikely to pass therethrough and air is allowed to pass therethrough. The mesh belt 46 moves as the stretching roller 47 revolves. While the mesh belt 46 moves continuously, the first sorted product that passed through the sorting section 40 is continuously piled up, and accordingly, the web V is formed on the mesh belt 46.

The suction mechanism 48 is provided below the mesh belt 46. The suction mechanism 48 can generate a downward air flow. By the suction mechanism 48, the first sorted product dispersed in the air from the sorting section 40 can be suctioned onto the mesh belt 46. Accordingly, the discharge speed from the sorting section 40 can be increased.

The web V is formed in a soft and swollen state containing a large amount of air by passing through the sorting section 40 and the first web forming section 45. The web V accumulated on the mesh belt 46 is charged into the pipe 17 and transported to the accumulation section 60.

The rotating body 49 cuts the web V. In the illustrated example, the rotating body 49 has a base portion 49*a* and a protrusion portion 49*b* protruding from the base portion 49*a*. The protrusion portion 49*b* has, for example, a plate-like shape. In the illustrated example, four protrusion portions 49*b* are provided, and four protrusion portions 49*b* are provided at equal intervals. By rotating the base portion 49*a* in a direction R, the protrusion portion 49*b* can rotate around the base portion 49*a* as an axis. By cutting the web V by the rotating body 49, for example, the fluctuation of the fiber amount per unit time supplied to the accumulation section 60 can be reduced.

The rotating body 49 is provided in the vicinity of the first web forming section 45. In the illustrated example, the rotating body 49 is provided in the vicinity of the stretching roller 47*a* positioned downstream in the path of the web V. The rotating body 49 is provided at a position where the protrusion portion 49*b* can come into contact with the web V and does not come into contact with the mesh belt 46 on which the web V is accumulated. Accordingly, it is possible to suppress abrasion of the mesh belt 46 by the protrusion portion 49*b*. The shortest distance between the protrusion portion 49*b* and the mesh belt 46 is, for example, 0.05 mm or more and 0.5 mm or less. This is the distance at which the mesh belt 46 can cut the web V without being damaged.

The mixing section 50 mixes, for example, the first sorted product that passed through the sorting section 40 and the binder. The mixing section 50 has, for example, a binder supply section 52 that supplies the binder, a pipe 54 for transporting the first sorted product and the binder, and a blower 56. In the illustrated example, the binder is supplied from the binder supply section 52 to the pipe 54 through a hopper 19. The pipe 54 is coupled to the pipe 17.

In the mixing section 50, an air flow is generated by the blower 56, and the first sorted product and the binder can be transported while being mixed in the pipe 54. The mechanism for mixing the first sorted product and the binder is not particularly limited, and may be stirred by a blade that rotates at high speed, or may use rotation of a container such as a V-type mixer.

As the binder supply section 52, a screw feeder, a disc feeder, or the like is used.

The binder supplied from the binder supply section 52 is, for example, starch or dextrin. Starch is a polymer in which a plurality of a-glucose molecules are polymerized by glycosidic bonds. The starch may be linear or may contain branches.

As the starch, those derived from various plants can be used. Raw materials for starch include grains such as corn, wheat, and rice, beans such as broad beans, mung beans, and red beans, tubers such as potatoes, sweet potatoes, and tapioca, wild grasses such as *Erythronium japonicum*, bracken, and kudzu, and palms such as sago palm.

Further, processed starch or modified starch may be used as the starch. Examples of the processed starch include acetylated adipic acid cross-linked starch, acetylated starch, oxidized starch, octenyl succinate starch sodium, hydroxypropyl starch, hydroxypropylated phosphoric acid cross-linked starch, phosphorylated starch, phosphoric acid esterified phosphoric acid cross-linked starch, urea phosphorylated esterified starch, sodium starch glycolate, and high amylose corn starch. Further, as the dextrin that serves as the modified starch, those obtained by processing or modifying the starch can be preferably used.

In the sheet manufacturing apparatus 1, by using starch or dextrin as a binder, at least one of gelatinization of the binder and hydrogen bonds between the fibers occurs by being pressurized and heated after moisture is applied, and the sheet S can be given sufficient strength. Meanwhile, when the sheet S can be given sufficient strength only by hydrogen bonds between the fibers, the sheet S can be manufactured without using a binder. When the sheet S is manufactured without using the binder, the sheet manufacturing apparatus 1 may not include the binder supply section 52.

The content of starch or dextrin in the sheet S is, for example, 0.1% by mass or more and 50% by mass or less, preferably 1% by mass or more and 40% by mass or less, and more preferably 1% by mass or more and 30% by mass or less. Such a content can be obtained by performing mixing when forming the mixture.

In addition, in the binder supply section 52, in addition to the binder, in accordance with the type of the sheet S to be manufactured, a colorant for coloring the fibers, an aggregation inhibitor for suppressing coagulation of fibers or coagulation of binder, a flame retardant for making fibers and the like unlikely to burn, and the like, may be included. The mixture that passed through the mixing section 50 is transferred to the accumulation section 60 through the pipe 54.

The accumulation section 60 introduces the mixture that passed through the mixing section 50 from an introduction port 62, unravels the entangled fibers, and disperses the unraveled fibers in the air to make the product fall. Accordingly, the accumulation section 60 can uniformly accumulate the mixture on the second web forming section 70.

The accumulation section 60 has, for example, a drum section 61 and a housing section 63 that accommodates the drum section 61 therein. As the drum section 61, a rotating cylindrical sieve is used. The drum section 61 has a net and makes fibers or particles smaller than the size of the mesh opening of the net, which are contained in the mixture that passed through the mixing section 50, fall. The configuration of the drum section 61 is, for example, the same as the configuration of the drum section 41.

The "sieve" of the drum section 61 may not have a function of sorting a specific object. In other words, the "sieve" used as the drum section 61 means a sieve provided with a net, and the drum section 61 may make all of the mixture introduced into the drum section 61 fall.

The accumulation section 60 includes a second web forming section 70. The second web forming section 70 accumulates the mixture that passed through the drum section 61 to form the web W. The second web forming section 70 includes, for example, a first mesh belt 72, a stretching roller 74, and a suction mechanism 76.

The mixture that passed through the opening of the accumulation section 60 is accumulated on the first mesh belt 72. The first mesh belt 72 is stretched by the stretching roller 74, and is configured such that the mixture is unlikely to pass therethrough and air is allowed to pass therethrough. The first mesh belt 72 moves as the stretching roller 74 revolves. While the first mesh belt 72 moves continuously, the mixture that passed through the accumulation section 60 is continuously piled up, and accordingly, the web W is formed on the first mesh belt 72.

The suction mechanism 76 is provided below the first mesh belt 72. The suction mechanism 76 can generate a downward air flow. By the suction mechanism 76, the mixture dispersed in the air from the drum section 61 can be suctioned onto the first mesh belt 72. Accordingly, the discharge speed from the accumulation section 60 can be increased. Furthermore, the suction mechanism 76 can form a downflow in the falling path of the mixture, and can prevent the fibers and the binder from being entangled during the fall.

As described above, the web W in a soft and swollen state containing a large amount of air is formed by passing through the accumulation section 60. The mechanism of the accumulation section 60 is not limited to that illustrated in the above-described embodiment, and various fiber accumulation mechanisms used in the airlaid method can be applied.

The web transport section 80 is disposed downstream of the web W in the transport direction on the first mesh belt 72. The web transport section 80 peels off the web W on the first mesh belt 72 from the first mesh belt 72 and transports the web W toward the sheet forming section 110.

Figure 2:
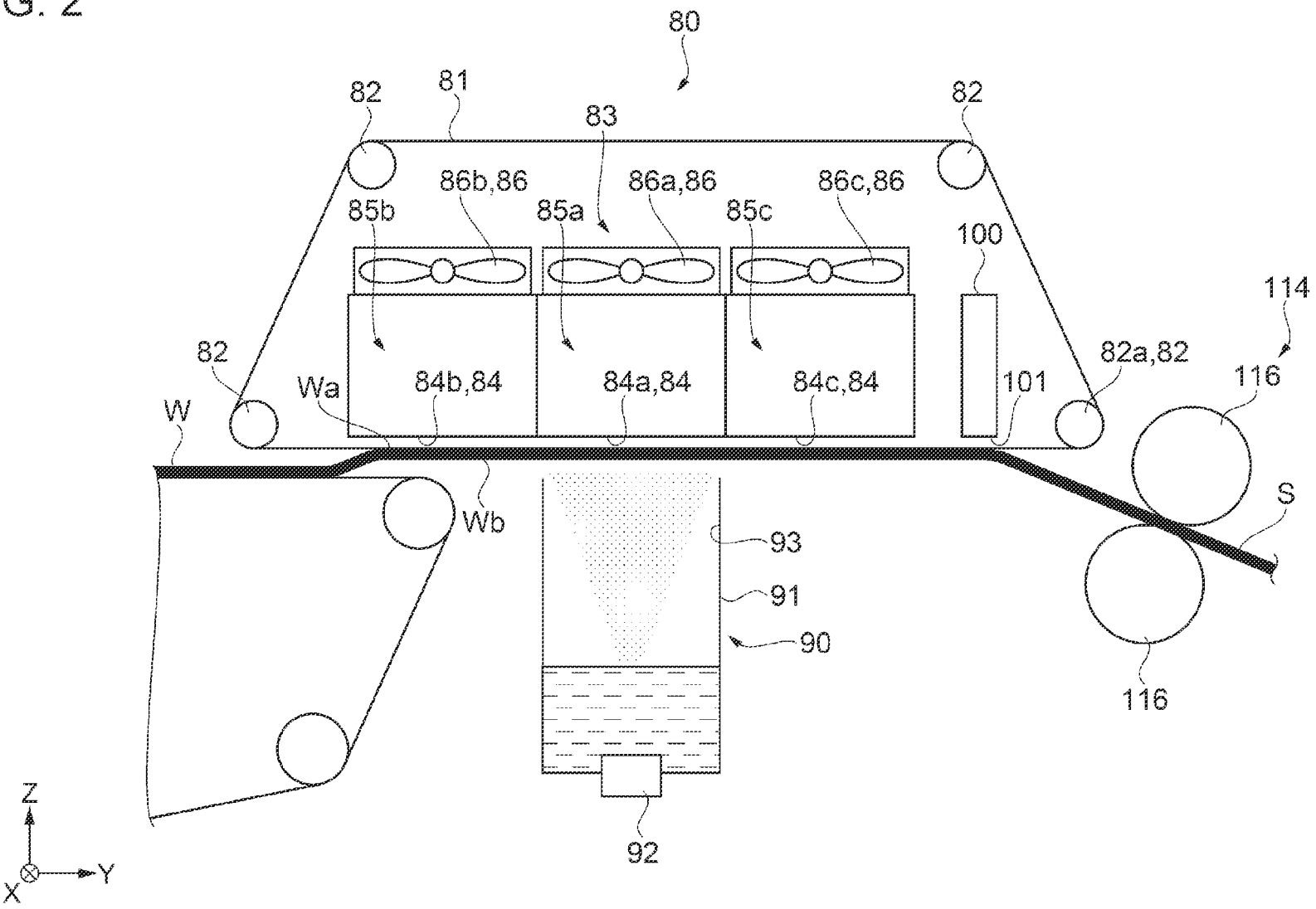
FIG. 2 is a partially enlarged view illustrating a configuration around a web transport section.

As illustrated in FIG. 2, the web transport section 80 includes a second mesh belt 81 as a transport belt, a plurality of rollers 82, and a suction mechanism 83 as a suction section. The second mesh belt 81 is stretched by the plurality of rollers 82, and is configured such that the air passes therethrough. The second mesh belt 81 is configured to be rotationally driven by the revolution of the rollers 82. The suction mechanism 83 is disposed at a position facing the web W with the second mesh belt 81 interposed therebetween. The suction mechanism 83 includes an intake fan 86 (in the present embodiment, a first intake fan 86*a*, a second intake fan 86*b*, and a third intake fan 86*c*), and generates an upward air flow in the second mesh belt 81 by the suction force of the intake fan 86. The web W is suctioned by this air flow.

More specifically, the suction mechanism 83 has a plurality of suction ports 84 for suctioning air. The suction port 84 of the present embodiment includes a first suction port 84*a*, a second suction port 84*b*, and a third suction port 84*c*. The second suction port 84*b* is provided to be adjacent to the first suction port 84*a* in the transport direction of the second mesh belt 81. In the present embodiment, the second suction port 84*b* is disposed in the −Y direction of the first suction port 84*a*. The third suction port 84*c* is provided at a position (+Y direction) adjacent to the first suction port. That is, the first suction port 84*a* of the present embodiment is positioned between the second suction port 84*b* and the third suction port 84*c* in the transport direction of the second mesh belt 81.

In addition, the suction mechanism 83 includes a first suction duct 85*a* coupled to the first suction port 84*a*, a second suction duct 85*b* coupled to the second suction port 84*b*, and a third suction duct 85*c* coupled to the third suction port 84*c*.

The first suction duct 85*a* is a flow path partitioned by a wall portion forming the first suction port 84*a*. The first intake fan 86*a* is disposed in the first suction duct 85*a*.

Figure 3:
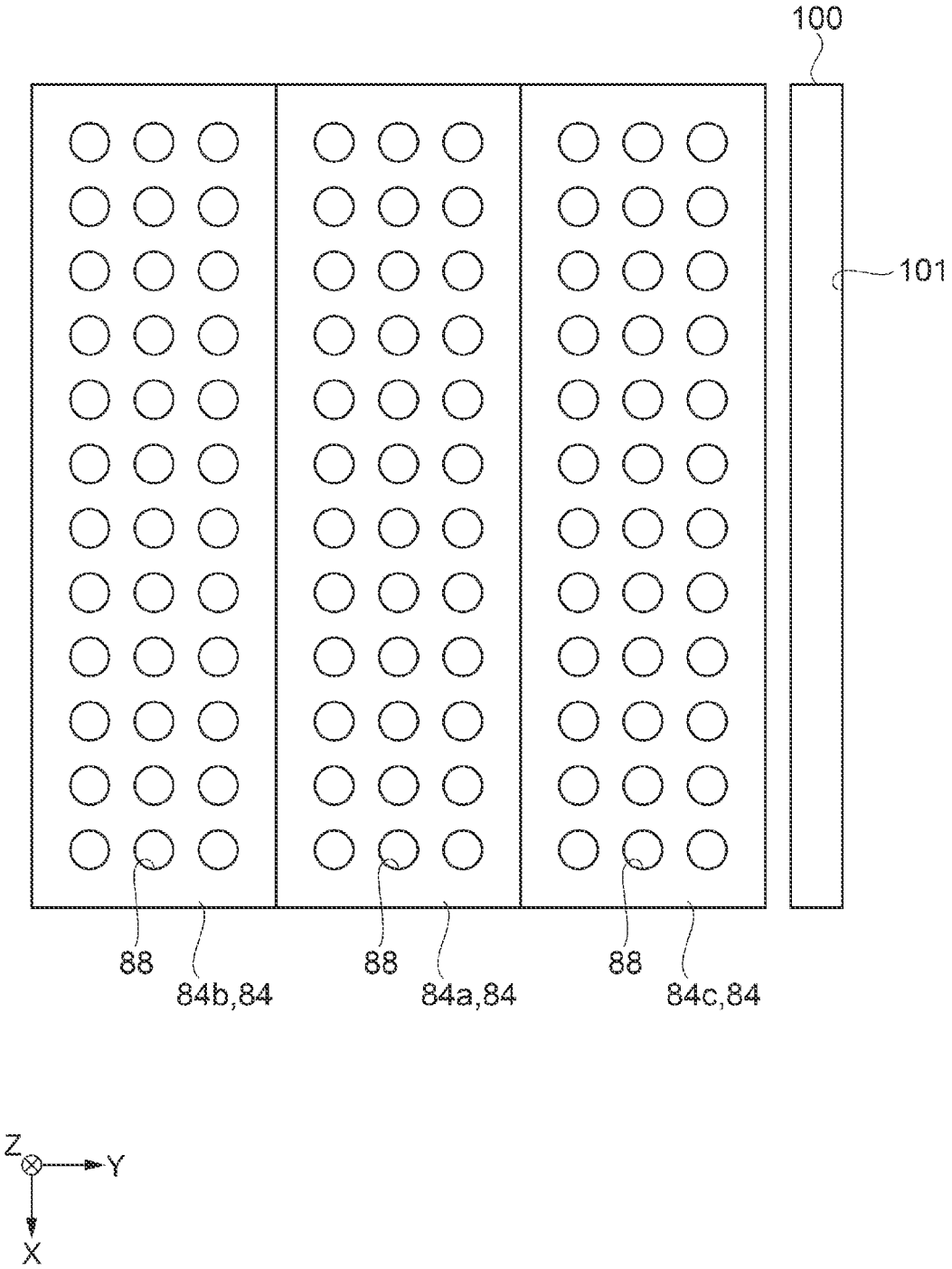
FIG. 3 is a view of the web transport section and an air ejection section as viewed in a +Z direction.

In addition, as illustrated in FIG. 3, each suction port 84 includes an elongated plate-shaped member extending along the X axis and a plurality of through-holes 88 formed in the plate-shaped member, when viewed in the +Z direction. By driving the first intake fan 86*a*, air is suctioned from the plurality of through-holes 88 through the first suction duct 85*a*.

The second suction duct 85*b* is a flow path partitioned by a wall portion forming the second suction port 84*b*. The second suction duct 85*b* is provided to be adjacent to the first suction duct 85*a* in the transport direction. The second intake fan 86*b* is disposed in the second suction duct 85*b*. By driving the second intake fan 86*b*, air is suctioned from the plurality of through-holes 88 through the second suction duct 85*b*.

The third suction duct 85*c* is a flow path partitioned by a wall portion forming the third suction port 84*c*. The third suction duct 85*c* is provided to be adjacent to the first suction duct 85*a* in the transport direction. The third intake fan 86*c* is disposed in the third suction duct 85*c*. By driving the third intake fan 86*c*, air is suctioned from the plurality of through-holes 88 through the third suction duct 85*c*.

By dividing into the suction ducts 85*a*, 85*b*, and 85*c* coupled to each of the suction ports 84*a*, 84*b*, and 84*c*, the amount of air suctioned in each of the suction ports 84*a*, 84*b*, and 84*c* can be stabilized.

Further, the first intake fan 86*a*, the second intake fan 86*b*, and the third intake fan 86*c* are individually controlled. In the present embodiment, the intake amount of the first intake fan 86*a* is controlled to be larger than the intake amount of the second intake fan 86*b*. Further, the intake amount of the second intake fan 86*b* and the intake amount of the third intake fan 86*c* are controlled to be substantially the same.

Accordingly, the web W can be peeled off from the first mesh belt 72, and one surface Wa, which is the upper surface of the web W peeled off from the first mesh belt 72, can be brought into contact with the second mesh belt 81. Then, one surface Wa of the web W comes into contact with the second mesh belt 81 and is transported in a state where the web W is held.

The humidification section 90 is disposed below the web transport section 80. The humidification section 90 is disposed to face the second mesh belt 81. The humidification section 90 applies moisture toward the other surface Wb, which is the lower surface of the web W that is in contact with the second mesh belt 81. In the humidification section 90, humidified air (for example, water vapor or mist) is applied to the web W as moisture.

As illustrated in FIG. 2, the humidification section 90 includes a container 91 capable of storing water and a piezoelectric vibrator 92 disposed at the bottom portion of the container 91. A discharge port 93 for discharging humidified air is formed at the upper portion of the container 91. The container 91 is disposed such that the discharge port 93 faces the other surface Wb side of the web W. By driving the piezoelectric vibrator 92, ultrasonic waves are generated in the water, mist (humidified air) is generated in the container 91, and the generated mist is supplied to the web W through the discharge port 93 of the container 91. By applying moisture to the web W from below, water droplets do not fall on the web W even when dew condensation is generated in the humidification section 90 or in the vicinity thereof. In other words, for example, when moisture is applied to the web W from above, there is a concern that the moisture adheres to the humidification section 90 or the vicinity thereof and falls as water droplets, and the water droplets adhere to the web W. In this case, the application of moisture to the web W becomes non-uniform. However, in the present embodiment, the falling of water droplets and the like is suppressed, and affecting the quality of the sheet S can be avoided.

Figure 4:
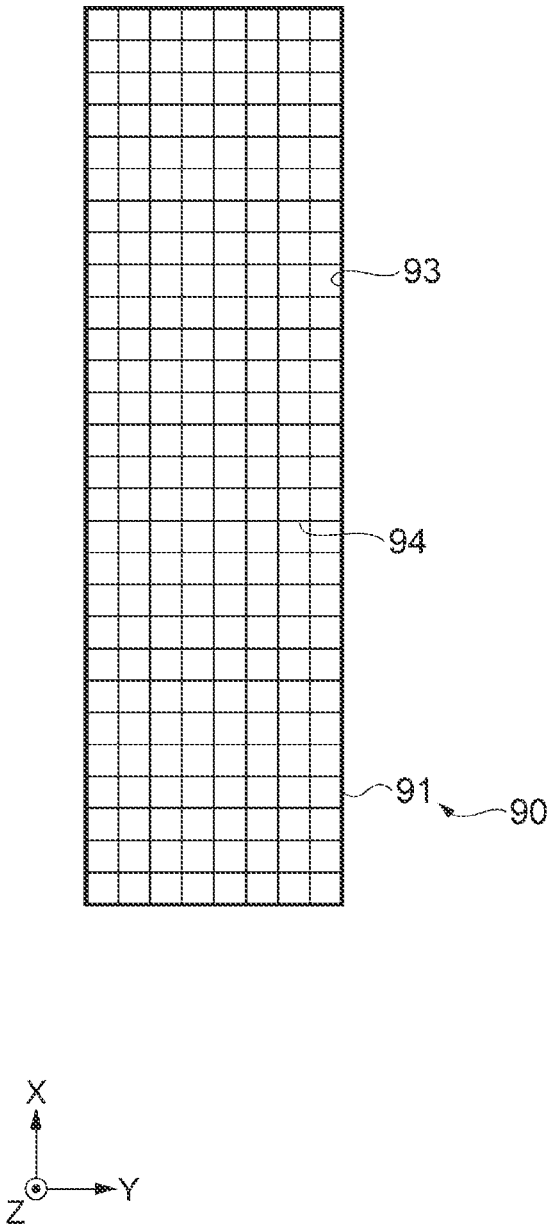
FIG. 4 is a view of a humidification section as viewed in a −Z direction.

Further, as illustrated in FIG. 4, the discharge port 93 of the humidification section 90 is an elongated rectangular shape extending along the X axis when viewed in the −Z direction. A wire net 94 is disposed at the discharge port 93 to suppress entrance of dust and the like into the container 91.

Here, the suction mechanism 83 is disposed at a position facing the humidification section 90 with the second mesh belt 81 interposed therebetween. In the present embodiment, the first suction port 84*a* and the discharge port 93 are disposed to face each other. Then, the first suction duct 85*a* suctions the humidified air discharged from the humidification section 90. As a result, the humidified air discharged from the discharge port 93 is suctioned from the first suction port 84*a* disposed facing the discharge port 93 through the first suction duct 85*a*. The humidified air is suctioned into the first suction port 84*a*, and accordingly, the humidified air passes through the web W in a state where the air flow of the humidified air is stable. As a result, the amount of moisture applied to the web W in the in-plane direction is made uniform.

Further, the opening shapes and sizes of the first suction port 84*a* and the discharge port 93 are the same. Specifically, the first suction port 84*a* and the discharge port 93 form a rectangular shape in plan view, and the dimensions along the X axis and the dimensions along the Y axis are substantially the same.

Therefore, for example, when the humidified air discharged from the discharge port 93 is suctioned from a suction port larger than the size of the discharge port 93, the air in other regions of the suction port including the periphery of the discharge port 93 is also suctioned. Therefore, the suction resistance at each suction port varies, and the air volume of the humidified air passing through the web W directly above the discharge port 93 varies. In the present embodiment, the first suction port 84*a*, the second suction port 84*b*, and the third suction port 84*c* are coupled to the first suction duct 85*a*, the second suction duct 85*b*, and the third suction duct 85*c*, respectively, and respectively functions independently. By making the opening shapes and sizes of the first suction port 84*a* and the discharge port 93 the same, the air volume of the humidified air passing through the web W directly above the discharge port 93 becomes constant. As a result, the amount of moisture in the web W in the in-plane direction is made uniform, variations in strength in the sheet surface can be suppressed, and the quality of the sheet can be ensured.

In addition, the second suction duct 85*b* and the third suction duct 85*c* bring the web W into close contact with the second mesh belt 81 by air intake. Therefore, the suction mechanism 83 has a function of peeling the web W off from the first mesh belt 72 and making the web W adhere to the second mesh belt 81, and a function of applying moisture in the thickness direction of the web W. Therefore, the configuration of the sheet manufacturing apparatus 1 can be simplified.

The water content of the web W to which moisture is applied in the humidification section 90 is preferably 12% by mass or more and 40% by mass or less. With the specified web water content, hydrogen bonds between fibers can be effectively formed and the strength of the sheet S can be increased.

The sheet forming section 110 is disposed downstream of the web transport section 80 and the humidification section 90. The web W to which the moisture is applied is transported to the sheet forming section 110.

Here, the air ejection section 100 is provided at the end portion of the web transport section 80 positioned on the sheet forming section 110 side. The air ejection section 100 ejects the compressed air to the web W.

As illustrated in FIG. 2, the air ejection section 100 is provided at a position adjacent to an outlet side roller 82*a* provided at the position closest to the sheet forming section 110 among the plurality of rollers 82 in the web transport section 80. More specifically, the air ejection section 100 is disposed between the downstream end portion of the suction mechanism 83 in the transport direction and the outlet side roller 82*a*. As a result, the web W can be efficiently peeled off from the second mesh belt 81.

The air ejection section 100 includes a compression section (not illustrated) that compresses the air and a nozzle 101 that discharges the compressed air. The nozzle 101 is provided at a position adjacent to the outlet side roller 82*a* and at a position facing the second mesh belt 81. As a result, the web W peeled off from the second mesh belt 81 can be transported to the sheet forming section 110.

The nozzle 101 has an elongated opening extending along the X axis when viewed in the +Z direction (FIG. 3). The length dimension of the nozzle 101 along the X axis is substantially the same as the length dimension of the web W transported by the web transport section 80 along the X axis.

Then, the air ejection section 100 ejects the compressed air to one surface Wa of the web W, which is in contact with the second mesh belt 81. Compressed air is ejected from the nozzle 101 in the entire direction along the X axis of the web W.

Since moisture is applied to the web W transported while being in contact with the second mesh belt 81 of the web transport section 80 by the humidification section 90, the adhesive force with respect to the second mesh belt 81 is increased, and the web W is stuck to the second mesh belt 81. When the web W is not peeled off from the second mesh belt 81 only by gravity, the web W is not smoothly transported to the sheet forming section 110, resulting in poor transport of the web W or damage to the web W.

According to the present embodiment, the second mesh belt 81 is pressed downward by ejecting the compressed air toward the web W before the sheet forming section 110 in the transport direction. As a result, the web W is peeled off from the second mesh belt 81, and the web W can be smoothly delivered to the sheet forming section 110. Therefore, it is possible to suppress poor transport of the web W or damage to the web.

The sheet forming section 110 forms the sheet S by applying moisture to the web W peeled off from the second mesh belt 81 and performing at least one of heating and pressurizing treatments. The sheet forming section 110 of the present embodiment simultaneously pressurizes and heats the web W to which moisture is applied. Accordingly, the moisture contained in the web W evaporates after the temperature rises, and the thickness of the web W becomes thin to increase the fiber density. The temperature of the moisture and the binder rises due to heat, the fiber density increases due to the pressure, and accordingly, the binder is gelatinized, and then the moisture evaporates to bind the plurality of fibers to each other through the gelatinized binder. Furthermore, the moisture evaporates due to heat and the fiber density increases due to the pressure, and accordingly, the plurality of fibers are bound to each other by hydrogen bonds. Accordingly, it is possible to form the sheet-shaped sheet S having better mechanical strength.

The sheet forming section 110 of the present embodiment has a pressurizing heating section 114 that pressurizes and heats the web W. The pressurizing heating section 114 can be configured by using, for example, a heating roller or a heat press molding machine. In the illustrated example, the pressurizing heating section 114 is composed of a pair of heating rollers 116. In the pair of heating rollers 116, the web W is heated to have a temperature of 60° C. or higher and 100° C. or lower. Further, the pair of heating rollers 116 applies pressure to the web W to thin the web W and increase the fiber density in the web W. The pressure applied to the web W is preferably 0.1 Mpa or more and 15 Mpa or less, more preferably 0.2 Mpa or more and 10 Mpa or less, and further preferably 0.4 Mpa or more and 8 Mpa or less. Within such a pressure range, deterioration of fibers can be suppressed, and the sheet S having good strength can be manufactured again using a defibrated product obtained by defibrating the manufactured sheet S as a raw material.

The number of pairs of heating rollers 116 is not particularly limited. The pair of heating rollers 116 can simultaneously pressurize and heat the web W. Further, the configuration of the sheet manufacturing apparatus 1 can be simplified.

Further, the sheet forming section 110 may include a pressure roller and a transport belt (for example, a mesh belt).

As illustrated in FIG. 1, the cutting section 120 cuts the sheet S formed by the sheet forming section 110. The cutting section 120 includes a first cutting section 122 that cuts the sheet S in the direction intersecting the transport direction of the sheet S, and a second cutting section 124 that cuts the sheet S in the direction parallel to the transport direction. For example, the second cutting section 124 cuts the sheet S that passed through the first cutting section 122.

As a result, a cut-form sheet S having a predetermined size is formed. The cut cut-form sheet S is discharged to a discharge receiving section 130. The sheet S manufactured by the sheet manufacturing apparatus of the present disclosure includes not only a thin sheet having a thickness of approximately 0.1 mm used for printing or the like but also a sheet-shaped molded products having a thickness of approximately 10 to 30 mm and applicable to various applications such as a cushioning material and a heat insulating material.

Next, the operations of the web transport section 80 and the air ejection section 100 will be described.

Figure 5A:
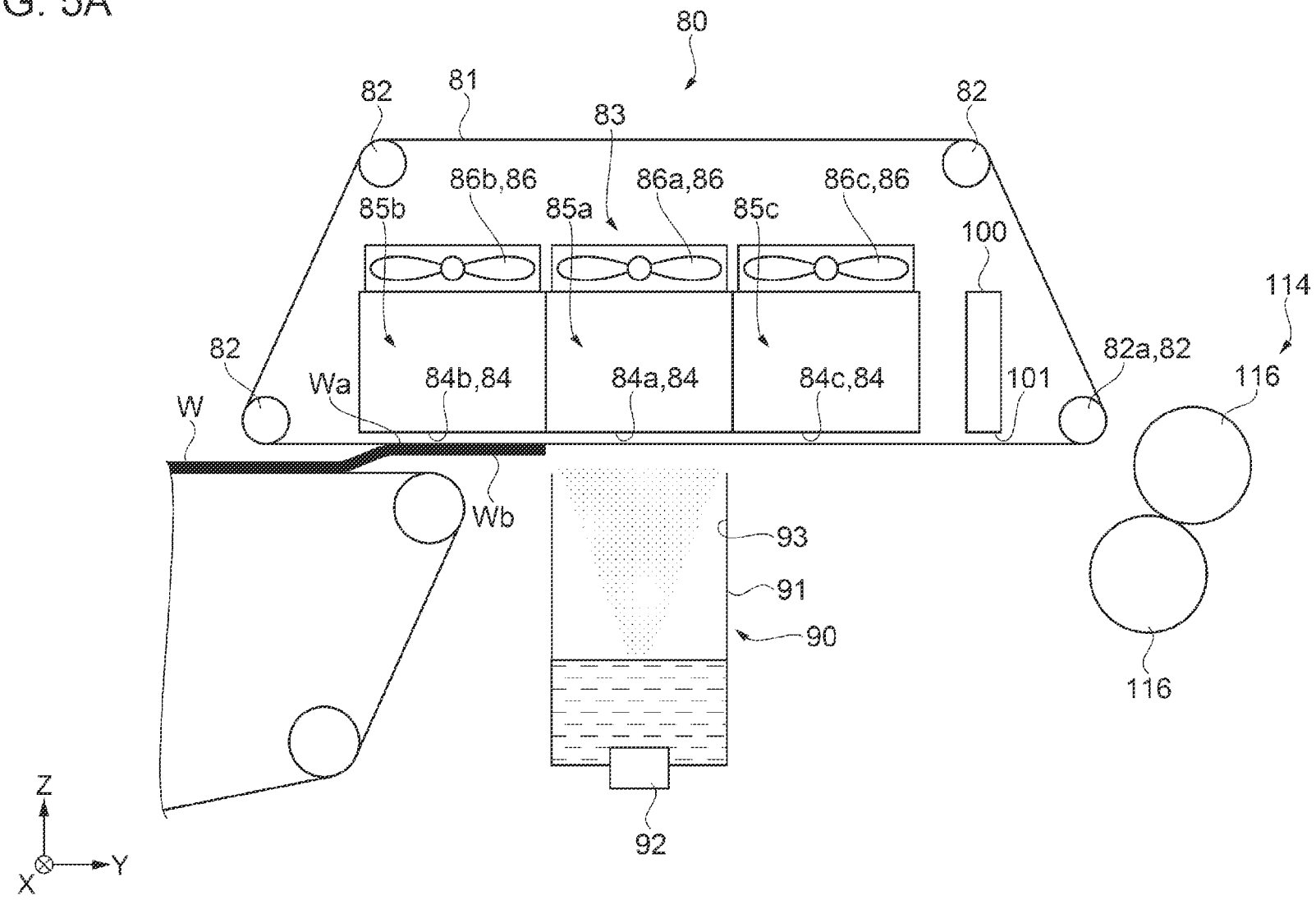
FIG. 5A is a schematic view illustrating an operation of the web transport section and the air ejection section.

As illustrated in FIG. 5A, the web W accumulated on the first mesh belt 72 is transported in the transport direction by the accumulation section 60. The suction mechanism 83 of the web transport section 80 generates an upward air flow in the second mesh belt 81 to suction the web W. Specifically, first, the web W is peeled off from the first mesh belt 72 by air intake from the second suction port 84*b*, and is transported in a state where one surface Wa of the web W is in contact with the second mesh belt 81.

Figure 5B:
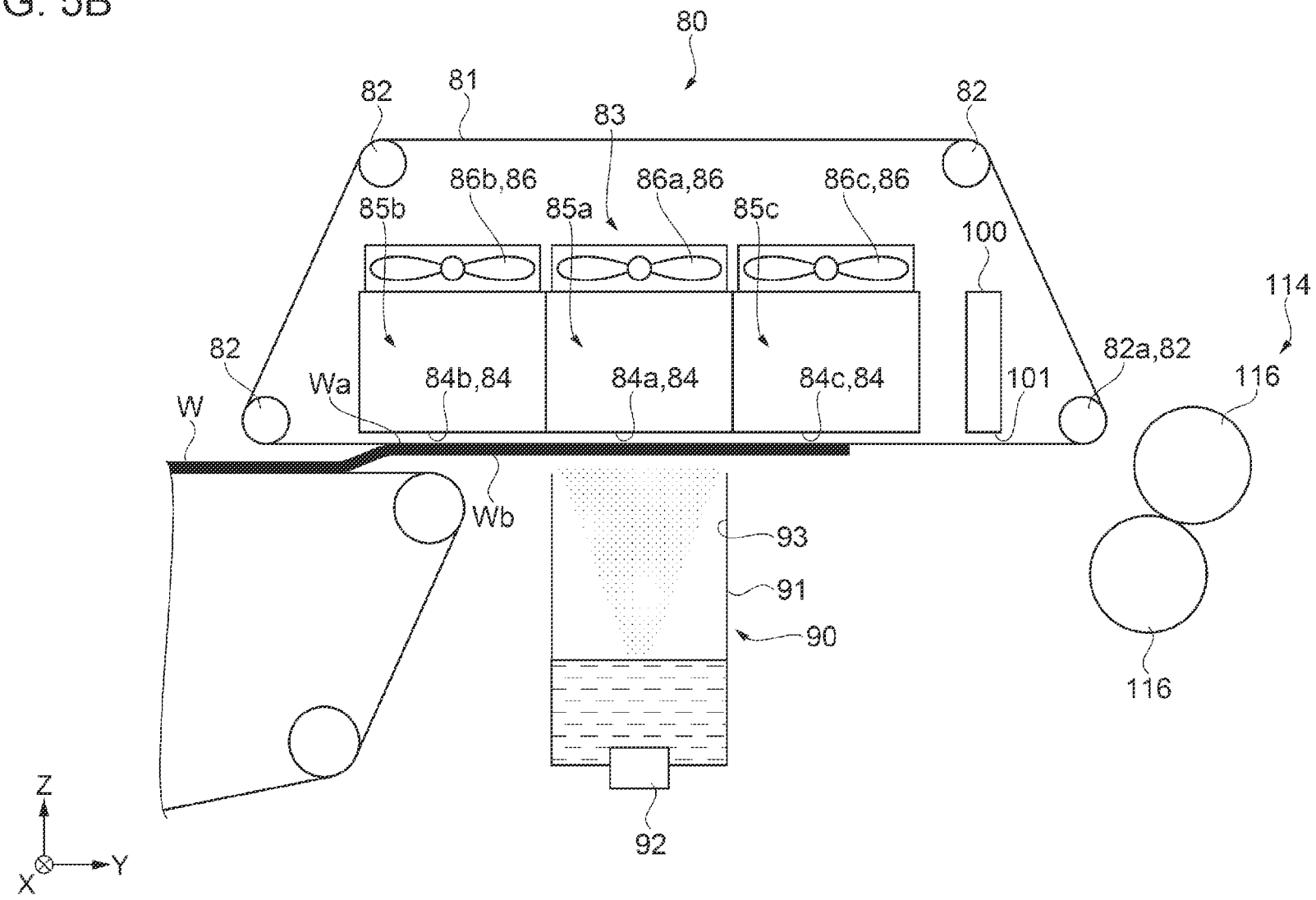
FIG. 5B is a schematic view illustrating an operation of the web transport section and the air ejection section.

Next, as illustrated in FIG. 5B, moisture (humidified air) is applied from the humidification section 90 to the web W transported by the web transport section 80. That is, in the present embodiment, moisture is applied to the web W during the transport period of the web W.

The humidified air discharged from the discharge port 93 of the humidification section 90 is suctioned from the first suction port 84*a* disposed above the discharge port 93. Since the humidified air is suctioned from the first suction port 84*a* via the web W, moisture can be uniformly applied in the thickness direction of the web W.

The web W is also suctioned by air intake from the first suction port 84*a*, and transported in a state where one surface Wa of the web W is in contact with the second mesh belt 81.

Figure 5C:
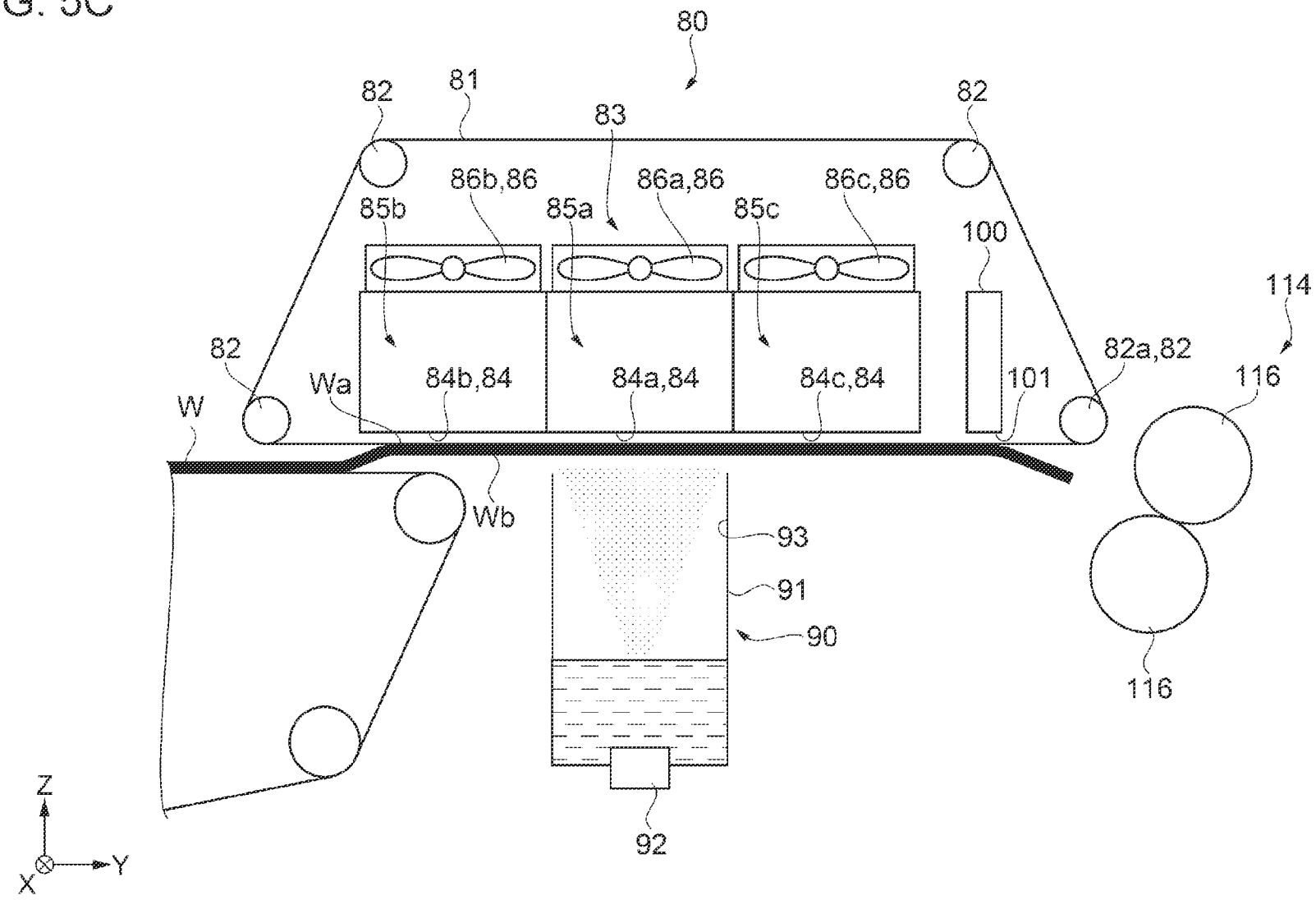
FIG. 5C is a schematic view illustrating an operation of the web transport section and the air ejection section.

Next, as illustrated in FIG. 5C, the web W to which moisture is applied is transported in a state where one surface Wa of the web W is in contact with the second mesh belt 81 by air intake from the third suction port 84*c*. After that, the web W is transported in a state of being in close contact with the second mesh belt 81 because the adhesive force increases by applying moisture.

Next, the air ejection section 100 ejects the compressed air from the nozzle 101 toward one surface Wa of the web W at the timing when the tip end of the web W passes the position facing the outlet side roller 82*a*. The ejection timing of the compressed air is controlled by, for example, a second mesh belt driving time, a detection sensor, or the like.

As a result, the tip end of the web W is peeled off from the second mesh belt 81 and hangs down. The tip end of the web W peeled off from the second mesh belt 81 is nipped into the pair of heating rollers 116 of the sheet forming section 110. After the tip end of the web W is nipped into the pair of heating rollers 116, the ejection of the compressed air is stopped.

The timing at which the compressed air is ejected from the air ejection section 100 can be appropriately set depending on the manufacturing conditions of the sheet S and the like. For example, the ejection may be performed for several seconds a few seconds before the tip end of the web W reaches the outlet side roller 82*a*. Further, the pressure, the ejection time, and the like of the compressed air ejected from the air ejection section 100 can be appropriately set.

As described above, according to the present embodiment, the humidified air discharged from the discharge port 93 of the humidification section 90 is suctioned by the suction force from the first suction port 84*a* disposed facing the discharge port 93. As a result, the humidified air is suctioned into the first suction port 84*a* via the web W, and thus the amount of moisture in the web W in the in-plane direction becomes uniform, the variation in the strength of the in-plane sheet S is suppressed, and the quality of the sheet S can be ensured.

Further, by making the opening shapes and sizes of the first suction port 84*a* and the discharge port 93 the same, the air volume of the humidified air passing through the web W directly above the discharge port 93 becomes constant. Thereby, the amount of moisture of the web W in the in-plane direction can be made uniform.

In the sheet manufacturing apparatus 1 of the present disclosure, the fibers discharged from the sorting section 40 may be directly supplied to the mixing section 50. In this case, the first web forming section 45 and the rotating body 49 are unnecessary. Then, a web V is not formed from the fibers discharged from the sorting section 40, and the fibers are supplied to the mixing section 50 as they are.

What is claimed is:

1. A sheet manufacturing apparatus that manufactures a sheet from a material containing fibers, the sheet manufacturing apparatus comprising:

an accumulation section including a first transport belt and forming a web by accumulating the material containing fibers on the first transport belt by an air flow;

a web transport section including a second transport belt that comes into contact with one surface of the web and holds the web, a part of the second transport belt facing the first transport belt, and;

a humidification section arranged to face one surface of the second transport belt and applying moisture from the other surface side of the web, the humidification section having a discharge port for discharging humidified air; and a suction section arranged to face the humidification section with the second transport belt interposed therebetween, the suction section having a plurality of suction ports to suction air, the plurality of suction ports including a first suction port and a second suction port that are arranged in a transport direction of the web, the first suction port facing the discharge port of the humidification section with the second transport belt interposed between the first suction port and the discharge port, the second suction port partially facing the first transport belt with the second transport belt interposed between the second suction port and the first transport belt.

2. The sheet manufacturing apparatus according to claim 1, wherein opening shapes and sizes of the first suction port and the discharge port are the same.

3. The sheet manufacturing apparatus according to claim 1, wherein the second suction port is arranged adjacent to the first suction port in the transport direction.

4. The sheet manufacturing apparatus according to claim 3, wherein the suction section has a first suction duct coupled to the first suction port and a second suction duct coupled to the second suction port.

5. The sheet manufacturing apparatus according to claim 4, wherein the second suction duct is provided adjacent to the first suction duct in the transport direction.

6. The sheet manufacturing apparatus according to claim 4, wherein the first suction duct suctions humidified air discharged from the humidification section.

7. The sheet manufacturing apparatus according to claim 4, wherein the second suction duct brings the web into close contact with the transport belt by air intake.

8. The sheet manufacturing apparatus according to claim 4, wherein the first suction duct has a first intake fan, the second suction duct has a second intake fan, and the first intake fan and the second intake fan are individually controlled.

9. The sheet manufacturing apparatus according to claim 3, wherein the plurality of suction port further has a third suction port arranged at a position adjacent to the first suction port, and the first suction port is positioned between the second suction port and the third suction port.

10. The sheet manufacturing apparatus according to claim 9, wherein the suction section has a third suction duct coupled to the third suction port.

* * * * *